US005980578A

United States Patent [19]

Kaussen et al.

[11] Patent Number: 5,980,578

[45] Date of Patent: Nov. 9, 1999

[54] PROCESS FOR WATERPROOFING LEATHER AT LOW PH-VALUES AND LEATHERS MANUFACTURED THEREBY

[75] Inventors: Manfred Kaussen, Aachen; Helmut Stoelcker, Krefeld, both of Germany

[73] Assignee: Stockhausen GmbH & Co. KG, Krefeld, Germany

[21] Appl. No.: 08/945,809

[22] PCT Filed: May 3, 1996

[86] PCT No.: PCT/EP96/01851

§ 371 Date: Nov. 12, 1997

§ 102(e) Date: Nov. 12, 1997

[87] PCT Pub. No.: WO96/35815

PCT Pub. Date: Nov. 14, 1996

[30] Foreign Application Priority Data

May 12, 1995 [DE] Germany ..... 195 16 961

[51] Int. Cl.[6] ..... C14C 9/00

[52] U.S. Cl. ..... 8/94.21; 8/94.2; 8/94.22; 8/94.33; 8/94.14; 8/94.23; 427/323; 427/389; 427/393.4; 252/8.57

[58] Field of Search ..... 8/94.2, 94.21, 8/94.22, 94.33, 94.14, 94.23; 427/323, 389, 393.4; 252/8.57

[56] References Cited

U.S. PATENT DOCUMENTS 5,124,181 6/1992 Schaffer et al. ..... 427/323
5,433,753 7/1995 Dahmen et al. ..... 8/84.23

FOREIGN PATENT DOCUMENTS

49489/93 3/1994 Australia .

OTHER PUBLICATIONS

Ullmann's Encylopedia of Industrial Chemistry, fifth edition, vol. A 15, pp. 274–277 (month unknown), 1990.

*Primary Examiner*—Alan Diamond
*Attorney, Agent, or Firm*—Oblon, Spivak, McClelland, Maier & Neustadt, P.C.

[57] ABSTRACT

The present invention relates to a process for waterproofing leathers, furs and other fibrous materials wherein waterproofing is carried out with conventional water repellents in the presence of dispersing or stabilizing auxiliary agents at pH-values of 3.5 to 5. Alkoxy-groups-containing copolymers, synthetic or natural fatliquors and/or synthetic retanning agents (syntans) are preferably used as dispersing or stabilizing auxiliary agents.

20 Claims, No Drawings

PROCESS FOR WATERPROOFING LEATHER AT LOW PH-VALUES AND LEATHERS MANUFACTURED THEREBY

TITLE OF THE INVENTION

This application is a 371 of PCT/EP/96/01851 filed May 3, 1996.

BACKGROUND OF THE INVENTION

Field of the Invention

A process for waterproofing leather at low pH-values and leathers manufactured thereby The present invention relates to a process for waterproofing leathers, furs, and other fibrous materials wherein the use of dispersing or stabilizing auxiliary agents with the water repellent renders the previously usual, but undesirable high pH-values no longer necessary to achieve a good water repellent action.

Description of the Background

Except for some special cases where water repellents are subsequently applied on the ready-made leather, hydrophobing is carried out from the aqueous float today. The water repellent effect can either be achieved by coating the fibrils and fibers of the leathers with hydrophobic compounds or it may be based on an incorporation of special emulsifiers capable of forming stable water-in-oil emulsions. As soon as water or moisture reaches or penetrates the leather, a water-in-oil emulsion is formed within the fiber interstices. The resultant swelling seals the leather. The structure and action of different kinds of auxiliary agents used for waterproofing is described by R. Nowak in "Leder- und Häutemarkt", 29 (1977), number 24.

Most of the water repellents used today are those responding to both of the above-mentioned mechanisms. Inversion makes it possible to convert products belonging to the class of substances forming water-in-oil emulsions into those forming oil-in-water emulsions. This may be effected by adding certain emulsifiers, changing the pH, by fixation with metallic salts, and other measures. Oil-in-water emulsions may be used in fatliquoring because of their optional dilutability with water. The water repellents used in practice belong to this type.

To achieve a good waterproofing effect, the water repellent must completely penetrate the leather cross section (Hodder, J. J., "Waterproof Leather Technologies and Processes", Waterproof Symposium on the occasion of the ALCA meeting, Pocono Manors, USA, 1994, publication in JALCA in preparation). A great handicap of the water repellents used so far lies in the fact that their oil-in-water emulsions tend to break at acid pH-values starting at about 5. Greasying on the grain and flesh side results, increasing in complete, mayonnaise-like precipitation of the product. The broken emulsion has an absolutely different emulsion or solution behavior which is likely to become apparent in the described precipitation, for example. The mayonnaise-like fatty substance can no longer penetrate the leather in fine or superfine dispersion to penetrate it uniformly. As a consequence the waterproofing effect becomes worse.

For this reason it has become common practice to set a pH-value preventing early emulsion breakdown, both in the float from which the water repellent or its oil-in-water emulsion is applied on the leather and in the leather. In this connection, neutralization has been of particular importance. Leather highly neutralized throughout the cross section, with a pH-value avoiding emulsion breakdown in all areas has been necessary to ensure penetration; in practice requiring a pH of 5 and above.

According to Friese et al. (Friese, H.-H., H. Constabel, W. Prinz, "Oberleder mit verbessertem Verhalten gegenüber Wasser", Leder-/Häute-Markt 35 , number 20, 1–3, 1983) neutralization to a pH-value of 5.5 in the leather cross section and 6.1 in the float was effected to make impregnated leathers of wet blue and a shaved substance of 2.2 mm. Uniform neutralization throughout the cross section is important in this context. Fatliquoring (here, the water repellent treatment carried out in the process step of fatliquoring) should be carried out at a minimum pH of 6.5 and at a highest possible temperature in order to achieve thorough "fatliquoring". If the leather had an insufficiently high pH-value across the whole cross section, but was more acidic in the middle, early breaking of the emulsion with reduced water equivalents could occur. The more acid central layer resulted in a kind of capillary action, causing an excessive water absorbency; in the Bally penetrometer (Lange, J., "Qualitätsbeurteilung von Leder, Lederfehler, Lederlagerung und Lederpflege", vol. 10 of "Bibliothek des Leders", Umschau Verlag 1982, pp. 119–123, and "Bestimmung des Verhaltens gegenüber Wasser bei dynamischer Beanspruchung im Penetrometer", DIN 53 338, April 1976) or in the Maeser testing apparatus ("Dynamic Water Resistance of Shoe Upper Leather by the Maeser Water Penetration Tester", ASTM D 2099-70, and Lange, J., "Qualitätsbeurteilung von Leder, Lederfehler, Lederlagerung und Lederpflege", vol. 10 of "Bibliothek des Leders", Umschau Verlag 1982, p. 124).

The two above-mentioned test methods to determine the hydrophobic property of leather are dynamic ones, i.e., the water absorption is determined under constant bending or compressive stress of the leather samples. The indication of the compression amplitude, the period up to water penetration, and the water absorption within certain time intervals according to the Bally-Penetrometer-Testing permit a sound assessment for the use-value of a water repellent leather finish. As a result of increased demands on satisfactory waterproofing, Bally test values with an amplitude of the leather of 7.5% are out-of-date. According to today's standards set points demanding an amplitude of 10% to 15% must be met, wherein the test periods amount to between 6 and 24 hours and the water absorption is required to be below 20%. With regard to "Maeser-Flexes" a value of at least 15,000 must be achieved for good waterproofing.

In DE 35 29 869 A1, Bay et al. describe a process for waterproofing leathers and furs which operates in a simple method under avoidance of organic solvents using silicone oil emulsions stabilized with N-acylamino acids (dimethylpolysiloxanes, page 3, line 41) at pH-values of 4.5–8, preferably 4.8–5.5. The embodiment examples A–E are carried out in the pH range of 5–6. According to page 4, lines 3–6, however, waterproofing is insufficient since a clear improvement can only be achieved by additionally using conventional water repellents of the type paraffin or wax emulsions.

Bay (Bay, H., "Ein Beitrag zur Hydrophobierung verschiedener Lederarten mit höheren Ansprüchen an die Wasserresistenz der Leder", Leder & Häute-Markt, 38, (1986) 24, Aug. 29, 1986, 77–79) describes as a top-waterproofing for highly waterproofed leathers the use of a purely aqueous emulsion of special silicone oils (Densodrin®S, BASF, Technical Information May 1988) according to the above-mentioned DE 35 29 869 A1, after the basic water repellent treatment has been carried out, for example, with Densodrin®GF. Under "Application" in the Technical Information (Densodrin®GF, BASF, Technische Information Dec. 1986) for this product it reads as follows: "To achieve good penetration including a water repellent effect throughout the leather cross section, a corresponding thorough deacidification is necessary, i.e., the cross section should be brought to a pH of above 5".

According to Hodder (Hodder, J.J., "Waterproof Leather Technologies and Processes", Waterproof Symposium on the occasion of the ALCA meeting, Pocono Manors, USA, 1994, publication in JALCA in preparation) polymeric softeners used as water repellents achieve good penetration only when applied in the pH-range of more than 5–6, depending on the respective polymer. Although a certain water repellency can be achieved at lower pH-values, the high demands on Maeser-flexes and water absorption require complete penetration which requires a relatively strong and complete neutralization of the chrome-tanned leather.

From the leather technological point of view the high pH-value is undesirable since it results in loose grain. To this regard Friese and Prinz (Friese, H.-H. and W. Prinz "Hydrophobierung modischer Leder", lecture held at the 35th Congress of AQEIC, 1st to 4th of May, 1986, in Murcia, Spain, published in Leder & Häute-Markt, 38 (1986) 32, Nov. 14, 1986, 5–10) describe the use of sulfonated carboxylic acid esters as emulsifiers in combination with alkyl phosphates to manufacture water repellent fatliquoring agents for soft, modern leather types. The high emulsion stability permits waterproofing down to a pH of 4.0. It is recommended to use an acrylate retanning agent to improve waterproofing throughout the leather cross section, prior to acidification. The water equivalents of the treated leathers were determined at 7.5% and 15% amplitude in the Bally penetrometer; however, very high, unacceptable water absorptions (up to 38%) occurred. There are no results on the Maeser Tester which places higher demands on successful waterproofing. It is known from practical experience with these complex-active water repellents that their hydrophobing action is preferably used for the (weaker) semi-waterproofing of modern, i.e., softer to very soft leathers. They are not suitable for highly waterproofed, firm leathers; this is explicitly stated in the above-mentioned publication on page 8, paragraph 3. This particularly applies to loosely structured and therefore sensitive raw materials, for example, the Brazilian Zebu. Moreover, they are highly sensitive to water hardness so that they can only be processed by using complexing agents.

In WO 92/1 3973, Friese and Prinz describe a fatliquoring agent for leather which is based on salts of phosphated OH-groups-containing glycerol tri-$C_{8-22}$-fatty acid esters, and a process which uses the fatliquor in treatment floats with pH-values of below 5 and then adjusts to acid pH-values of 4.8 or less. If indicated at all, the embodiment examples show an insufficient waterproofing of the leathers; for example, in the Bally penetrometer water penetrates after only 240 minutes, and the water absorption is at about 10%-wt. after only one hour.

SUMMARY OF THE INVENTION

Accordingly, it is the object of the present invention to provide auxiliary agents or a technology which overcomes the above-mentioned drawbacks of the art. This in particular involves the possibility of manufacturing highly waterproofed leathers in a process at a low pH-value, wherein both soft thin and rigid firm leather qualities are included with equal perfection. Moreover, the process is intended to be applicable in an optimum manner, irrespective of the water hardness, and, if possible, it should allow a simplified process of leather manufacture.

Most surprisingly, it has been found that this becomes possible by using dispersing or stabilizing auxiliary agents in addition to the water repellent. The first-mentioned ones have the function of introducing the water repellent or its emulsion into the interior of the leather to a large extent, despite the unfavorable pH-conditions, and of ensuring a good distribution. Stabilizers increase the stability of the emulsion which can therefore penetrate deeper into the leather. Basically any substance is useful which has a good dispersive or stabilizing effect without having an excessive hydrophilic action. These include special copolymers, fatliquors, and also certain synthetic retanning agents, the so-called syntans which are characterized by their insensibility to acids and salts.

DETAILED DESCRIPTION OF THE INVENTION

In the journal "Das Leder", 33 (1982), pages 142–154 F. Schade and H. Traubel specify the structure of different syntans which, for example, may be cocondensates from a selection of the raw materials naphthalenesulfonic acid, 4,4'-dihydroxydiphenyl sulfone, aniline, dicyandiamide, sulfonated diarylethers, oligophenyl-sulfonic acids, and formaldehyde. Further indications as to syntans can be found, for example, in "Ullmanns Enzyklopädie der technischen Chemie", 4th edition 1978, volume 16, pages 137–144.

Syntans without remarkable hydrophilic properties can be synthesized and used according to the present invention by varying several raw materials or their concentrations used. Syntans are used both in liquid and powdery form, the powdery form mostly being loaded with cutting agents from the manufacturing process (spray drying).

Alkoxy-groups-containing copolymers based on monomer mixtures of a) 1–99% -wt. water-soluble, ethylenically unsaturated, acid-groups-containing monomers and/or unsaturated dicarboxylic acid anhydrides, b) 1–50% -wt. ethylenically unsaturated, mono- or polyalkoxylated monomers, and c) 0–60% -wt. of further monomers copolymerizable with a) and b), with the proviso that the weight percentage of a), b), and c) make up to 100%, are suitable for both supporting the water repellent action and achieving good firmness and excellent fullness of the leather. Such alkoxy-groups-containing polymers are described, for example, in the patent documents U.S. Pat. No. 4,962,173, U.S. Pat. No. 4,872,995, U.S. Pat. No. 4,847,410, and DE 42 27 974 A1.

Suitable monomers of group a) include polymerizable, water-soluble, acid-groups-containing, ethylenically unsaturated monocarboxylic acids, their anhydrides and their salts; sulfonic acids and unsaturated dicarboxylic acids, their anhydrides and their semi-esters or semiamides. Examples thereof include (meth)acrylic acid, (meth)allyl sulfonic acid, vinylacetic acid, 2-acrylamido-2-methyl-propane sulfonic acid, vinylsulfonic acid, styrylsulfonic acid, maleic acid, maleic anhydride, fumaric acid, itaconic acid, and the semiesters and semiamides of the above- mentioned dicarboxylic acids, the semiesters and semiamides being obtainable by reaction of the corresponding acid anhydrides with alcohols, amines, and amino alcohols. Preferred monomers are acrylic acid, methacrylic acid, maleic acid, and maleic anhydride.

The monomers of group b) may be obtained either by alkoxylation of ethylenically unsaturated, at least one hydroxy- or amino-group-containing compounds, or by reaction of the alkoxy adducts of saturated aliphatic, cycloaliphatic, aromatic alcohols, amines, or thiols with ethylenically unsaturated carboxylic acids, reactive carboxylic acid derivatives, or allyl halides. Examples thereof include ethylene and/or propylene oxide-adducts of (meth) allyl alcohol, (meth)allyl amine, and hydroxyethyl (meth) acrylate, optionally further reacted with reactive saturated acid derivatives. Additional examples include the reaction products of ethylene glycol, isopropyl glycol, butyl glycol, as well as nonylphenol, isotridecanol, which are preferably capped at one end, with ethylene or propylene oxide and further reaction of the alkylene oxide adducts with (meth) acrylic acid, allyl chloride, or other reactive, unsaturated acid derivatives, for example, the acid anhydrides, the acid halides, or the acid esters. Among these adducts the preferred ones are methoxypolyethylene glycol (meth) acrylates, nonylphenol polyglycol (meth)acrylates, and allyl alcohols, each having 5 to 30 ethylene oxide units.

All monomers which are copolymerizable with a) and b) may be used as monomers of groups c). They are used to modify the polymers further and thus permit an optimum adjustment to the water repellents to be used according to the present invention. For this reason the monomers according to c) may have both a hydrophilic and a hydrophobic character. Examples include (meth) acryl-amide, dimethylaminopropyl (meth)acrylamide, (meth)acrylonitrile, (meth) acrylic-acid ester, hydroxyethyl (meth)acrylate, N-vinyl pyrrolidone, N-vinyl imidazole, N-vinyl acetamide, vinyl acetate, vinyl propionate, versatic acid vinyl ester, styrene.

The polymers are produced by bulk, solution or emulsion polymerization under conditions for these polymerization methods with respect to selection of the reactors, solvents, polymerization temperatures, initiators, regulators, stabilizers, and further usual polymerization aids, which are known to the skilled artisan.

The number-average molecular weight of the polymers is in the range of 500 to 100,000 g/mol, a preferred molecular weight ranges between 500 and 50,000 g/mol, and particularly preferred between 500 and 20,000 g/mol. The copolymers are preferably used in dissolved or emulsified form.

Owing to possible foam formation in the presence of further surface-active substances, in particular of synthetic retanning agents (syntans), they are preferably used after neutralization or also during retannage. The copolymers may be applied prior to or simultaneously with the water repellent.

Among the fatliquoring agents to be used according to the present invention in particular the synthetic products based on sulfochlorinated paraffins or chloroparaffins provide a deep thorough fatliquoring shown in a dry surface. Although these types of fatliquors, because of the chemical structure, are said to have a wetting effect on leathers and thus reduce the water repellent action, good waterproofing values have surprisingly been achieved. It seems that the hydrophilic character is overcompensated by the stabilization of the water repellent. (Strongly dispersing syntans show a similar behavior, provided that they do not have extreme hydrophilic properties). In addition to synthetic fatliquors, those based on natural raw materials may also be used in the process according to the present invention. These include both the fatty substances of animal origin, such as fish oil, whale oil, neatsfoot oil, tallow, and vegetable oils, such as those obtained from cottonseed, castor, sunflowers, peanuts, or olives. The water-miscible products are often modified by hydrophilic sulfonic groups. They are obtained by sulfation, sulfitation, or formation of sulfonic acids. The use of a mixture of different synthetic and natural fatliquors in the process according to the present invention proved to be advantageous. Synthetic fatliquors based on copolymers may also be used according to the present invention; however, they must have a sufficient stabilizing action at pH-values of 5 or less in this case too.

In addition to the advantageous operating method at reduced pH, the use of the dispersing or stabilizing products according to the present invention permits employment of the major water repellent portion already in neutralization/retannage so that simplified formulations may be obtained. The leather's absorption capacity for the water repellent is higher in the early neutralization/retannage state than at a later stage, during "actual" waterproofing. So-called compact operations are thereby favored or made possible at all; they reduce the processing steps (base fatliquoring—base waterproofing—top-waterproofing) in leather manufacturing. However, the greatest advantage is the possibility of avoiding exposure of sensitive raw materials to a high pH which involves deliberate provocation of an inferior quality.

Despite the low pH-values of the working floats of the process according to the present invention, which are in the range of 3.5 to 5, preferably of 4–5, and particularly preferred between 4.3–4.7, there are no precipitations including resultant greasying. Usually, the leather surface is dry, and the leathers have an excellent waterproof behavior. Depending on the leather thickness, processing time, and tannage the pH-value in the leather may be 0.2 to 0.3 pH-units lower than that of the float.

The amounts of dispersing auxiliary agent used range between 2–10% and preferably between 2–5%, relative to the shaved weight of the used wet-blue material or to the wet weight of the furs.

The subject matter of the present invention also includes leathers, furs, and other fibrous materials which have been rendered waterproof according to the process of the present invention.

The following embodiment examples will illustrate the present invention in greater detail. It is shown that the leathers may be waterproofed both in multistage and compact processing (direct method) according to the process of present invention. The excellent hydrophobic properties of the leathers are shown by measurements with the Bally-Penetrometer or with the Maeser-Test.

EXAMPLE 1 a) Production of the used alkoxy-groups-containing copolymer 325 g deionized water, 138 g acrylic acid, 10 g dodecylbenzene sulfonic acid, 12 g nonylphenoxy-(14 EO)methacrylate, 0.2 g mercaptoethanol, and 1 g of a 0.6% iron(II)-sulfate solution are placed in a three-neck glass flask equipped with stirrer and condenser. Polymerization is started at 20° C. by simultaneous addition of a solution of 3.6 g sodium persulfate in 10 g water and 1.8 g sodium bisulfite in 10 g water. A temperature maximum of 99° C. is reached within 5 minutes. The reaction is continued at 80° C. for two hours. After 30 and after 90 minutes, 1.8 g and 1 g of the peroxo compound in 7 g water are added for secondary catalysis. After a total reaction time of two hours, 27.3 g butyl diglycol is added, and the mixture is neutralized by adding 104.3 g of a 25% ammonia solution. A finely-dispersed, flowable emulsion with 30% active substance is obtained which may be diluted with water at will.

Viscosity (Brookfield RVM, Sp. 6, 10 rpm): 19,000 mPas, pH-value (1:10): 6.4.

b) Application in Leather Technology

Shoe upper leather, waterproofed, white

| | | | | |
|---|---|---|---|---|
| Material: | chrome-tanned, South American Zebu-skins | | | |
| Shaved substance: | 2.0–2.2 mm | | | |
| Percentages relate to shaved weight | | | | |
| WASHING: | 300.0% | water 30° C. | | |
| | 0.5% | oxalic acid ) | | |
| | 2.0% | synth. white ) tanning agent | | 20 min. |
| Drain off bath | | | | |
| NEUTRALIZATION: | 100.0% | water 35° C. | | |
| | 2.5% | sodium acetate pH: 4.4–4.5 | undissolved | 90 min. |
| Drain off bath | | (cross section evenly neutralized throughout) | | |
| WASHING: | 300.0% | water 35° C. | | 5 min. |
| Drain off bath | | | | |
| RETANNING/ | 100.0% | water 35° C. | | |
| WATERPROOFING: | 4.0% | copolymer acc. a) | 1:5 | 20 min. |
| | +6.0% | water repellent | 1:4 in 60° C. | 60 min. |
| | +6.0% | synth. white tanning agent ) | | |
| | 4.0% | polymer tan. agent ) with softening and ) filling action ) pH: 4.6–4.7 | | 45 min. |
| | +0.5% | formic acid | 1:5 | 20 min. |
| Drain off bath | | pH: 4.1 | | |
| WATERPROOFiNG: | 100.0% | water 55° C. | | |
| | 0.5% | copolymer acc. a) | 1:5 | 10 min. |
| | 2.0% | water repellent | 1:4 in 60° C. | 45 min. |
| Drain off bath | | | | |
| WASHING: | 300.0% | water 20° C. | | |
| | 1.0% | formic acid | 1:5 | 10 min. |
| Drain off bath | | | | |
| FIXATION: | 100.0% | water 25° C. | | |
| | 0.5% | formic acid pH: 3.2 | 1:5 | 10 min. |
| | +2.5% | zirconium tanning ag. | undissolved | 60 min. |
| Drain off bath | | | | |
| 2× WASHING: | 300.0% | water 25° C. | | 10 min. |

Leather horse-up overnight, setting out, vacuum drying (3 min./65° C.), suspension drying, conditioning, staking, air-off (vacuum 30 sec./65° C.).

In the Bally penetrometer at 10% amplitude the leather showed water penetration after >420 minutes at a water absorption of 11%.

EXAMPLE 2

Upper leather, waterproofed. dyed

| | | | | |
|---|---|---|---|---|
| Material: | chrome-tanned, South American Zebu-skins | | | |
| Shaved substance: | 1.8–2.0 mm | | | |
| Percentages, relative to shaved weight | | | | |
| WASHING: | 300.0% | water 35° C. | | |
| | 0.3% | oxalic acid | | 15 min. |
| Drain off bath | | | | |
| RETANNING: | 100.0% | water 45° C. | | |
| | 1.0% | chrome sulfate 25/33 | undis. | 10 min. |
| | 2.0% | chrome-containg., highly exhausting synth. retan. agent | undis. | 60 min. |
| | 1.0% | sodium formate | | |
| Drain off bath | | pH: 4.0 | | |
| NEUTRALIZING/ | 100.0% | water 35° C. | | |
| RETANNING/ | 1.0% | sodium formate | | |
| WATERPROOFING: | 3.0% | neutralizing synth. aux. tannin | | 60 min. |
| | | pH: 4.5 (Leather cross section through-neutralized) | | |
| | +3.0% | copolymer acc. to Example 1a) | 1:5 | 20 min. |
| | +6.0% | water repellent | 1:4 in 60° C. | 45 min. |
| | +4.0% | neutralizing synth. auxiliary tannin | | 90 min. |
| | 5.0% | chestnut extract, powder | | |
| | 3.0% | dye | | |
| | +0.3% | formic acid | 1:5 | 20 min. |
| Drain off bath | | pH: 3.9–4.0 | | |
| WASHING: | 300.0% | water 45° C. | | 10 min. |
| Drain off bath | | | | |
| WATERPROOFING: | 100.0% | water 45° C. | | |
| | 0.1% | ammonia | 1:5 | 5 min. |
| | +1.0% | copolymer acc. to Exampe 1a) | 1:5 | 10 min. |
| | +4.0% | water repellent | 1:4 in 60° C. | 60 min. |
| | +0.5% | formic acid | 1:5 | 20 min. |
| Drain off bath | | pH: 4.0 | | |
| FIXATION: | 100.0% | water 40° C. | | |
| | 3.0% | commercial self-basifying chrome tan. agent | undis. | 90 min. |
| Drain off bath | | | | |
| 2× WASHING: | 300.0% | water 25° C. | | 10 min. each |

Leather horse-up overnight, setting out, vacuum drying (3 min./80° C.), suspension drying, conditioning, staking, air-off (vacuum 30 sec./75° C.).

In the Bally-Penetrometer at 10% amplitude the leather showed water penetration after >420 minutes at a water absorption of 9%.

Maeser Test: Number of flexes >165,000/>165,000 Water absorption % 14110

EXAMPLE 3 (Compact Processing)

Cattle upper leather. nubuck. waterproofed

Direct method

| | | | |
|---|---|---|---|
| Material: | chrome-tanned US-cattle hides | | |
| Shaved substance: | 1.8 mm | | |
| Percentages, relative to shaved weight | | | |
| Retanning/Waterproofing/Dyeing in same bath | | | |
| | 100.0% | water 35° C. | |
| | 6.0% | neutralizing aux. tannin | 60 min. |
| | | pH: 4.6 | |

-continued

| | | | | |
|---|---|---|---|---|
| | +3.0% | copolymer acc. to Ex. 1a) | 1:5 | 10 min. |
| | 3.0% | dye ) | | |
| | 0.3% | sodium bicarbonate ) | undis. | 10 min. |
| | +8.0% | wat repellent | 1:4 in 60° C. | 45 min. |
| | +8.0% | synth/veget. mixed tann. agent | | 60 min. |
| | +1.0% | formic acid pH: 3.8 | 1:5 | 2 × 20 min. |
| | +3.0% | chrome sulfate 25/33 | | 90 min. |
| | +1.0% | dye | | 15 min. |
| | +0.5% | formic acid | | 20 min. |
| Drain off bath | | pH: 3.5 | | |
| WASHING: | 200.0% | water 50° C. | | 10 min. |

Leather horse-up overnight, setting out, vacuum drying (3 min./80° C.), suspension drying, conditioning, staking, buffing 220/280.

In the Bally-Penetrometer at 10% amplitude the leather showed water penetration after >420 minutes at a water absorption of 9%.

EXAMPLE 4

Cattle upper leather, nubuck, waterproofed

Direct operation

| | | | | |
|---|---|---|---|---|
| Material: | chrome-tanned, European cattle hides | | | |
| Shaved substance: | 1.8–2.0 mm | | | |
| Percentages relate to shaved weight | | | | |
| WASHING: | 300.0% | water 35° C. | | |
| | +0.3% | oxalic acid | | 20 min. |
| Drain off bath | | | | |
| WASHING: | 200.0% | water 35° C. | | 10 min. |
| Drain off bath | | | | |
| RETANNING: | 150.0% | water 35° C. | | |
| | +4.0% | chrome syntan | | 40 min. |
| | +2.0% | sodium formate ) | | |
| | 5.0% | neutralizing aux. tannin ) | | 60 min. |
| Drain off bath | | pH: 4.6 | | |
| WATERPROOFING/ | 150.0% | water 45° C. | | |
| RETANNING/ | +2.0% | copolymer acc. to Ex. 1a) | 1:5 | 20 min. |
| DYEING: | +5.0% | water repellent ) | | |
| | 5.0% | polym. softener ) | 1:4 in 60° C. | 90 min. |
| | +8.0% | synth/veget. mixed tann. ag. ) | | 60 min. |
| | 3.0% | dye ) | | |
| | +4.0% | amphot. copoly. | | 40 min. |
| | +1.5% | formic acid | 1:5 | 2 × à 20 min. |
| Drain off bath | | pH: 3.8 | | |
| TOP-WATER- | 200.0% | water 50° C. | | |
| PROOFING: | +0.2% | ammonia | | 5 min. |
| | +1.0% | copolymer acc. to Ex. 1a) | 1:5 | 10 min. |
| | +2.0% | water repellent | 1:4 in 60° C. | 40 min. |
| | +0.7% | formic acid | | 20 min. |
| Drain off bath | | pH: 3.7–3.8 | | |
| FIXATION: | 150.0% | water 35° C. | | |
| | 3.0% | chrome sulfate 25/33 | | 90 min. |
| Drain off bath | | pH: 3.8 | | |
| WASHING: | 200.0% | water 50° C. | | 10 min. |

Leather horse-up overnight, setting out, vacuum drying (3 min./80° C.), suspension drying, conditioning, staking, buffing 220/280.

In the Bally penetrometer at 10% amplitude the leather showed water penetration after >420 minutes at a water absorption of 13%.

| | | |
|---|---|---|
| Maeser Test: | Number of flexes | >45,000/>45,000 |
| | Water absorption % | 11/12 |

We claim:

1. A process for waterproofing leathers, furs, and other fibrous materials, comprising contacting a fibrous material in a float at a pH of 3.5 to 5 with a dispersing or stabilizing auxiliary agent comprising an alkoxy-containing copolymer having a molecular weight of 500 to 100,000 consisting of the following monomer units (α) 1–99% -wt. of water soluble, ethylenically unsaturated, acid group-containing monomers and/or unsaturated dicarboxylic acid anhydrides and/or their salts, (β) 1–50% -wt. of ethylenically unsaturated, mono- or polyalkoxylated monomers, and (γ) 0–60% -wt. of additional monomers copolymerizable with (α) and (β), with the proviso that the weight percentage of (α), (β), and (γ) make up to 100%, where the alkoxy-containing copolymer consists of elements selected from C, H, O, N and S; and contacting the fibrous material in the float with a water repellent.

2. The process according to claim 1, wherein the dispersing or stabilizing auxiliary agent further comprises sulfochlorinated paraffins or chloroparaffins.

3. The process according to claim 1, wherein the dispersing or stabilizing auxiliary agent is mixed with the water repellent and used together.

4. The process according to claim 1, wherein the dispersing or stabilizing auxiliary agent is used in a neutralization/retannage step.

5. The process according to claim 1, wherein a major portion of the water repellent is used during a neutralization/retannage step.

6. The process according to claim 1, wherein the dispersing or stabilizing auxiliary agent is contacted with the fibrous material at a pH from 4.0 to 5.0.

7. The process according to claim 1, wherein the dispersing or stabilizing auxiliary agent is contacted with the fibrous material at a pH from 4.3 to 4.7.

8. The process according to claim 1, wherein the dispersing or stabilizing auxiliary agent is used in an amount of 2 to 10% -wt. relative to a shaved weight of the fibrous material.

9. The water-proofed fibrous material obtained by the process of claim 1.

10. The water-proofed fibrous material of claim 9, which is a leather or a fur.

11. A process for waterproofing leathers, furs, and other fibrous materials, comprising contacting a fibrous material at a pH of 3.5 to 5 with a dispersing or stabilizing auxiliary agent comprising an alkoxy-containing copolymer having a molecular weight of 500 to 100,000 consisting of the following monomer units (α) 1–99% -wt. of water soluble, ethylenically unsaturated, acid group-containing monomers and/or unsaturated dicarboxylic acid anhydrides and/or their salts, (β) 1–50% -wt. of ethylenically unsaturated, mono- or polyalkoxylated monomers, and (γ) 0–60% -wt. of additional monomers copolymerizable with (α) and (β), with the proviso that the weight percentage of (α), (β), and (γ) make up to 100%, where the alkoxy-containing copolymer consists of elements selected from C, H, O, N and S; and contacting the fibrous material with a water repellent, wherein the dispersing or stabilizing auxiliary agent is mixed with the water repellent and used together.

12. The process according to claim 11, wherein the dispersing or stabilizing auxiliary agent further comprises sulfochiorinated paraffins or chloroparaffins.

13. The process according to claim 11, wherein the dispersing or stabilizing auxiliary agent is used in a neutralization/retannage step.

14. The process according to claim 11, wherein a major portion of the water repellent is used during a neutralization/retannage step.

15. The process according to claim 11, wherein the dispersing or stabilizing auxiliary agent is contacted with the fibrous material at a pH from 4.0 to 5.0.

16. The process according to claim 11, wherein the dispersing or stabilizing auxiliary agent is contacted with the fibrous material at a pH from 4.3 to 4.7.

17. The process according to claim 11, wherein the dispersing or stabilizing auxiliary agent is used in an amount of 2 to 10% -wt. relative to a shaved weight of the fibrous material.

18. A water-proofed fibrous material obtained by the process of claim 11.

19. The water-proofed fibrous material of claim 18 which is a leather or a fur.

20. A process for waterp roofing leathers, furs, and other fibrous materials, comprising contacting a fibrous material in a float at a pH of 3.5 to 5 with a dispersing or stabilizing auxiliary agent comprising an alkoxy-containing copolymer having a molecular weight of 500 to 100,000 consisting of the following monomer units (α) 1–99% -wt. of water soluble, ethylenically unsaturated, acid group-containing monomers and/or unsaturated dicarboxylic acid anhydrides, the acid group-containing monomers and dicarboxylic acid anhydrides being selected from the group consisting of acrylic acid, (meth)acrylic acid, (meth)allyl sulfonic acid, vinylacetic acid, 2-acrylamido-2-methylpropane sulfonic acid, vinylsulfonic acid, styrysulfonic acid, maleic acid, maleic anhydride, flmaric acid, itaconic acid, and the semiesters and semi,des of maleic acid, fimaric acid and itaconic acid, (β) 1–50% -wt. of ethylenically unsaturated, mono- or polyalkoxylated monomers selected from the group consisting of methoxypolyethylene glycol (meth) acrylate, nonylphenol polyglycol (meth)acrylate, ethylene and/or propylene oxide-adducts of (meth) allyl alcohol, (meth)allyl amine, and hydroxyethyl (meth)acrylate, and reaction products of at least one of ethylene glycol, isopropyl glycol, butyl glycol, nonylphenol and isotridecanol with ethylene or propylene oxide, and (γ) 0–60% -wt. of additional monomers copolymerizable with (α) and (β) selected from the group consisting of (meth)acrylamide, dimethylaminopropyl (meth)acrylamide, (meth)acrylonitrile, hydroxyethyl (meth)acrylate, N-vinylpyrrolidone, N-vinyl imidazole, N-vinyl acetamide, vinyl acetate, vinyl propionate, versatic acid vinyl ester, and styrene, with the proviso that the weight percentage of (α), (β), and (γ) make up to 100%; and contacting the fibrous material in the float with a water repellent.

* * * * *